US005643518A

United States Patent [19]

Yang et al.

[11] Patent Number: 5,643,518

[45] Date of Patent: Jul. 1, 1997

[54] PROCESS FOR PREPARING FIBERS OF SOLUBLE WHOLLY AROMATIC POLYAMIDES

[75] Inventors: Jen-Chang Yang; Hsiao-Chuan Chang; Jin-Chyueh Lin; Lien-Tai Chen, all of Taiwan, Taiwan

[73] Assignee: Industrial Technology Research Institute, Hsinchu, Taiwan

[21] Appl. No.: 413,830

[22] Filed: Mar. 30, 1995

[51] Int. Cl.[6] ..... D01D 5/06; D01F 6/60

[52] U.S. Cl. ..... 264/184; 264/203; 264/210.8; 264/211.15; 264/211.16; 264/233

[58] Field of Search ..... 264/184, 210.8, 264/211.12, 211.14, 211.15, 211.16, 233, 234, 203

[56] References Cited

U.S. PATENT DOCUMENTS

| | | | |
|---|---|---|---|
| 3,287,324 | 11/1966 | Sweeny | 528/348 |
| 3,360,598 | 12/1967 | Earnhart | 264/205 |
| 3,414,645 | 12/1968 | Morgan, Jr. | 264/184 |
| 3,642,706 | 2/1972 | Morgan, Jr. | 264/184 X |
| 3,751,546 | 8/1973 | Horolot | 264/184 |
| 3,869,429 | 3/1975 | Blades | 264/184 X |
| 4,073,837 | 2/1978 | Kouzai et al. | 264/184 X |
| 4,342,715 | 8/1982 | Shimada et al. | 264/184 |
| 4,842,796 | 6/1989 | Matsui et al. | 264/184 |

*Primary Examiner*—Leo B. Tentoni
*Attorney, Agent, or Firm*—Sughrue, Mion, Zinn, Macpeak & Seas

[57] ABSTRACT

Soluble wholly aromatic polyamide is obtained by low-temperature polycondensation in an amide solvent such as N-methyl-2-pyrrolidone. The reaction mixture is neutralized with an alkali and spun into fibers by wet spinning, coagulated in a salt-free aqueous solution of an organic solvent, preferably the polymerization solvent, and subsequently drawn in another aqueous solution of the same organic solvent, both solutions being substantially at ambient temperatures below 50° C. but above freezing, More than 60% of the total fiber drawing is executed in this low-temperature draw stage.

13 Claims, No Drawings

PROCESS FOR PREPARING FIBERS OF SOLUBLE WHOLLY AROMATIC POLYAMIDES

FIELD OF THE INVENTION

The present invention relates to a process for preparing the fibers of wholly aromatic polyamides that remain soluble in their polymerization mixture.

BACKGROUND OF THE INVENTION

Aromatic polyamides that remain soluble in their polymerization mixture have been known for a long time. Many such polymers containing meta-phenylene rings were synthesized in the 1950's {S. L. Kwolek and H. H. Yang, "*History of Aramid Fibers*" in "*Manmade Fibers: Their Origin and Development*" ed. by R. B. Seymour and R. S. Porter, Elsevier Applied Science (1993)}. The most notable of these polymers is poly(m-phenylene isophthalamide) (MPD-I). Because of its excellent thermal and textile-like properties, the fiber of MPD-I was commercialized first by Du Pont Co. in 1962 under the tradename of Nomex aramid, later by Teijin Ltd. of Japan under the tradename of Teijinconex, and by the former USSR under the name of Fenilon.

In the preparation of aromatic polyamides, the method of low temperature polycondensation is widely used which employs an amide solvent and often an alkali salt. The amide solvents for low temperature polycondensation include hexamethylphosphoramide (HMPA), N,N'-dimethyl acetamide (DMAc), N-methyl-2-pyrrolidone (NMP) and other derivatives. HMPA must be used with caution because of its suspected carcinogenic properties. DMAc and NMP are both used commercially. The alkali salts include calcium chloride, lithium chloride, lithium hydroxide, and the like. These salts are added to a polymerization system to improve the solubility of the polymer in the polymerization mixture, or to neutralize the polymerization mixture, so as to achieve a high degree of polymerization. Soluble aromatic polyamides such as MPD-I are often polymerized without alkali salts because of their high solubility in amide solvents.

Fibers of soluble aromatic polyamides can be prepared conveniently by directly spinning from the polymerization solution followed by processing. The spinning process includes the conventional dry spinning (U.S. Pat. Nos. 3,287,324 and 3,360,598) and wet spinning (U.S. Pat. Nos. 3,414,645, 3,642,706, 3,751,546, 3,869,429, 4,073,837, 4,342,715, 4,842,796) processes. The as-spun fibers are generally processed by washing, wet drawing, drying and hot drawing to achieve certain properties. The dry spinning process has the disadvantages of relatively high cost of solvent recovery and potential risk of environmental contamination. As a result, the wet spinning process has been favored over the dry spinning process in recent years.

In many cases of wet spinning, the polymer solution is spun from a spinneret into an aqueous coagulation bath containing at least 40% by weight of calcium chloride and at a temperature of 50° C. or higher. Further, most polymer solutions contain calcium chloride from the solvent/salt system or from neutralization of the polymer solution. The high content of calcium chloride in the coagulation bath reduces the diffusion rate of calcium chloride from a spinning fiber. This results in a highly solvated fiber that will draw readily. The drawing is further facilitated by the use of a high coagulation bath temperature. However, the high temperature of the coagulation bath tends to accelerate the diffusion rate of calcium chloride. Such contradictory effects of high salt content and high temperature of coagulation and draw baths have heretofore been overlooked.

SUMMARY OF THE INVENTION

It is therefore an object of this invention to provide a process for preparing fibers of soluble wholly aromatic polyamides in which the contradictory effects of high salt content and high temperature of coagulation and draw baths during fiber spinning are avoided.

It is a further object of this invention to provide a simple low-cost process for fiber preparation which permits effective coagulation and extraction without affecting the fiber drawing and while enhancing efficient solvent/salt separation and solvent recovery.

The present invention provides a relatively simple, low-cost process for preparing fibers of soluble wholly aromatic polyamides by spinning the polymerization mixture into a salt-free aqueous coagulation solution of an organic solvent, preferably the same solvent as the polymerization solvent, and subsequently drawing in a second salt-free aqueous solution of an organic solvent, preferably the same organic solvent as the polymerization solvent and/or the solvent in the aqueous coagulation solution. Both solutions are at substantially ambient temperature below 50° C. but above freezing. More than 60% of the total fiber drawing is executed in this low-temperature draw stage.

DETAILED DESCRIPTION OF THE INVENTION

In this invention, it has been found that the high temperature and high salt content of the coagulation and draw baths can be avoided by using aqueous solutions of an organic solvent for coagulation and drawing during fiber formation at substantially ambient temperature below 50° C. but above freezing. More than 60% of fiber drawing is executed in the low-temperature draw bath. The fiber thus obtained exhibits chemical and physical properties that are at least equivalent to those obtainable by prior art methods for corresponding polymer molecular weights.

The present invention provides a relatively simple low-cost process that avoids the high energy consumption of heating and salt removal, Also, when the polymerization solvent is used to formulate the coagulation and drawing baths, the process is further simplified in regard to solvent recovery.

The soluble wholly aromatic polyamides of the present invention include wholly aromatic homopolymers and copolymers containing at least 85 mole percent of repeat units of aromatic radicals. All of these polymers remain soluble in the polymerization mixture at the conclusion of polymerization reaction. These wholly aromatic polyamide polymers also should have a sufficiently high molecular weight to achieve enough mechanical strength so that shaped articles made from them exhibit useful properties.

By "wholly aromatic polyamide" is meant a linear polymer containing at least 85 mole percent of recurring structural units represented by the following general formulas:

$$—[—NR_1—Ar_1—NR_2—CO—Ar_2—CO—]—$$

$$—[—NR_3—Ar_3—CO—]—$$

wherein $Ar_1$, $Ar_2$ and $Ar_3$ are aromatic radicals, such as

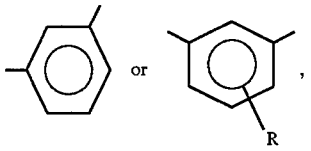

where R represents, for example, $CH_3$, Cl, $OCH_3$, CN, $CH_3CO$, and $NO_2$, and $Ar_1$ and $Ar_2$ may be the same or different; $R_1$, $R_2$ and $R_3$ are a lower alkyl group, for example a $C_1$ to $C_6$ alkyl group, or hydrogen, and $R_1$ and $R_2$ may be the same or different.

The polymerization mixture prior to polymerization generally contains 5 to 30 weight percent of polymer, less than 50 weight percent of alkali salt, the remainder being one or more amide solvents. The wholly aromatic polyamides used in this invention are obtained by polymerizing an aromatic diamine and an aromatic diacid chloride in an amide solvent with or without an alkali salt. After polymerization, the polymerization mixture can contain up to 2 moles of hydrogen chloride per mole of polymer. In some cases, the hydrogen chloride is neutralized by the addition of an alkaline solution, e.g., sodium hydroxide, to the polymerization mixture to avoid polymer degradation by hydrochloric acid. In these cases, the polymerization mixture prior to spinning will contain less than 50 weight percent of alkali salt from the solvent/salt system and the neutralization reaction.

The polymerization mixture to be used in this invention is deaerated under atmospheric pressure or vacuum, filtered, and optionally heated to below 150° C., if needed, to reduce the solution viscosity to a convenient processing level. It is then extruded downward through a spinneret having a plurality of capillary holes into a coagulation bath. The spinneret may be placed at a distance greater than 1 mm above the surface of the coagulation fluid, or immersed in the coagulation fluid. The coagulation fluid is a salt-free aqueous solution of organic solvent, preferably the same solvent as the polymerization solvent, at a concentration below 40 weight percent. The organic solvent is present in the coagulation fluid in an amount of 3 weight percent or more. The coagulation fluid is held at substantially ambient temperature below 50° C., but above freezing. The extruded solution is coagulated to form shaped filaments and undergoes partial extraction of its solvent and salt contents while passing through the coagulation bath. The shaped filaments are attenuated at a draw ratio of 2–2.5 by a draw force acting on the spinning filaments. The extent of coagulation and solvent/salt extraction of the shaped filaments in the coagulation bath is determined by the spinning speed and the requirement that a substantial portion of filament drawing occurs in the next draw bath.

The coagulated and partially extracted filaments exiting the coagulation bath are passed into a salt-free draw bath containing an aqueous solution of organic solvent, preferably the same solvent as the polymerization solvent, at a concentration below 40 weight percent. The organic solvent is present in the draw bath in an amount of 3 weight percent or more. For obvious reasons, the draw bath fluid contains preferably as the solvent the same solvent as the coagulation fluid, but the solvent may be at the same or a different concentration from that in the coagulation fluid. The draw bath is held at substantially ambient temperature below 50° C. but above freezing. The shaped filaments are drawn at a draw ratio of 2–2.5 by a draw force while passing through the draw bath. The drawn filaments become fully coagulated and contain only a moderate amount of solvent and salt, preferably the combined amount of solvent and salt is no more than 30 percent by weight of polymer when exiting the draw bath. Further, more than 60% of the total drawing is executed in the draw bath.

It is to be noted that the key features of this invention include the use of aqueous solutions of organic solvent, and preferably the solvent is at a concentration below 40 weight percent and at 3 weight percent or more for the coagulation fluid and the draw bath fluid, both being held at substantially ambient temperature below 50° C. but above freezing. Also, more than 60% of total fiber draw is executed in the draw bath. These conditions provide effective coagulation and drawing which give rise to satisfactory fiber properties. The solvent content of the coagulation bath and that of the draw bath can be varied, depending on the solvent/salt content of the polymerization mixture and the desired fiber drawing. The steps of fiber coagulation and wet draw can be combined and carried out in one step.

The drawn filaments exiting the draw bath can be passed through a water bath at substantially ambient temperature. The solvent content of the washed filament exiting the water bath is reduced to a residual level, preferably below about 0.05% by weight of polymer, and the salt content of the washed filaments is reduced to an acceptably low level, preferably below about 1% by weight of polymer.

The washed filaments exiting the water bath can be dried at a modest tension of about 0.1–0.5 g/d by conventional heated rolls or in a heated tubular oven. The dried filaments are wound up on a tube as a bundle of filament yarn at a predetermined speed. The dry yarn may be optionally subjected to hot drawing at a draw ratio of greater than 1.1 at a temperature near the glass transition temperature of the wholly aromatic polyamide. For example, wholly aromatic polyamides usually have a glass transition temperature of about 270° C. and will be degraded if subjected to heat treatment at a temperature above 370° C. The dry yarn is preferably subjected to a hot drawing at a temperature between 250° and 350° C. The drying and hot drawing processes may be coupled in direct sequence or in separate steps.

The resulting fibers of the invention have a linear density of greater than 0.25 denier/filament.

The invention will now be described in greater detail with reference to the following non-limiting examples. Unless otherwise indicated all percents, parts, and ratios are by weight.

EXAMPLE 1

This example illustrates the preparation of a soluble wholly aromatic polyamide, poly(m-phenylene isophthalamide) (MPD-I) and the fiber of this polymer.

In a 5-liter jacketed cylindrical glass reactor with a pair of wall-wiping helical mixing blades was placed a mixture of 409.0 g (3.78 mole) of m-phenylenediamine (MPD) in 3605 g (3500 ml) of anhydrous N-methyl-2-pyrrolidone (NMP) under nitrogen purge. With the mixing blades at gentle stirring, ice water was circulated through the reactor jacket in order to cool the MPD/NMP solution to about 0° C. After about 15 minutes, 767.9 g (3.78 mole) of isophthaloyl chloride (ICl) in fine powder form was slowly added to the glass reactor. As the reactor temperature began to rise and the reaction mixture became increasingly viscous, the circulation of ice water through the reactor jacket was continued and the mixing speed was gradually increased, After about 20 minutes of reaction time, the circulation of ice water through the reactor jacket was reduced so that the reactor temperature was allowed to rise from about 0° C. to 60° C. in the ensuing 10–15 minutes. The reaction was terminated at that time by transferring the reaction mixture into a storage vessel and allowing the mixture to stand. Upon cooling to ambient temperature, the reaction mixture became a highly viscous gel-like mass of light amber color. The polymerization mixture contained about 20% by weight of MPD-I polymer. The polymer had an inherent viscosity ($\eta_{inh}$) of 1.1 dL/g as measured at a polymer concentration (c) of 0.5 g/100 ml in 97% sulfuric acid at 30° C. and as determined from the relative viscosity ($\eta_{rel}$) according to the following equation:

$$\eta_{inh}=ln(\eta_{rel})/c.$$

To prepare for fiber spinning, the reaction mixture was neutralized by mixing with 559.4 g of calcium hydroxide. The neutralized polymer solution was heated to 70° C., filtered and deaerated under a vacuum for 4 hours. The polymer solution was extruded at a rate of 10.8 ml/min through a spinneret with 100 capillary holes of 0.08 mm diameter and 0.12 mm length. The extruded solution passed through an air gap of 2.5 cm into a coagulation fluid. The coagulation fluid contained 15% by weight of NMP in water, and was held at ambient temperature of about 20° C. The extruded solution traveled a distance of about 40 cm in the coagulation fluid and exited the coagulation bath at a speed of about 17 m/min.

The coagulated and partially extracted filaments exiting the coagulation bath were led into a draw bath containing 20% by weight of NMP in water at ambient temperature of about 20° C. A considerable amount of drawing was effected while the filaments traveled a distance of about 100 cm in the draw bath and exited at a speed of 40 m/min.

The drawn filaments were washed with water in two successive wash baths at ambient temperature. The filaments traveled a distance of 100 cm in the first wash bath and exited at 42 m/min; and traveled a distance of 100 cm in the second wash bath and exited at 46 m/min.

The drawn filaments were wound up on a bobbin as a filament yarn. It was subsequently dried in air. The dry yarn was subjected to hot drawing at a draw ratio of 1.2 at 330° C. The process conditions, polymer and fiber properties described above are summarized in Table 1.

EXAMPLE 2

This example illustrates alternate process conditions for preparing fibers of MPD-I. The process of Example 1 was repeated except that the air gap length, coagulation fluid, speeds, draw ratios and filament denier were changed as summarized in Table 1.

The neutralized polymer solution of Example 1 was heated to 70° C., filtered and deaerated under a vacuum for 4 hours. The polymer solution was extruded at a rate of 11.1 ml/min through a spinneret with 100 capillary holes of 0.08 mm diameter and 0.12 mm length. The extruded solution passed through an air gap of 1.5 cm into a coagulation fluid containing 20% by weight of NMP in water at ambient temperature. The coagulated and partially extracted filaments exited the coagulation bath at a speed of 15 m/min and entered a draw bath containing 20% by weight of NMP in water at ambient temperature. The drawn filaments exited the draw bath at a speed of 31 m/min, and were then washed twice with water at speeds of 36 and 37 m/min respectively. After drying and windup, the filament yarn was subjected to hot drawing at 330° C. at a draw ratio of 1.2. The properties of the resulting yarn are summarized in Table 1. Because the same solvent concentration and process temperature are used for the coagulant and wet draw baths, these two steps can be combined as one step.

COMPARATIVE EXAMPLE

This example illustrates the preparation of fibers of MPD-I according to Shimada et al. U.S. Pat. No. 4,342,715.

The neutralized polymer solution of Example 1 was heated to 100° C. filtered, and extruded at a rate of 9.65 ml/min through a spinneret used in Example 1. The extruded solution passed through an air gap of 7 mm into a first coagulation bath containing 5% by weight of NMP in water at 18° C., and then into a second coagulation bath containing 40% by weight of calcium chloride in water at 95° C. The coagulated and extracted filaments were subjected successively to a first washing at 18° C., a second water wash at 50° C., wet drawing in water at 80° C. at a draw ratio of 2.5, a third water washing at 90° C., drying at 120° C., and finally were hot drawn at 370° C. at a draw ratio of 1.4. The resulting filament yarn had a linear density of 310 denier at 3.1 denier per filament. It exhibited a tenacity of 3.1 g/d and elongation at break of 29%. These results are compared to those of Examples 1 and 2 in Table 1 below.

TABLE I

| | Example 1 | Example 2 | Comparative Example |
|---|---|---|---|
| Extrusion Conditions: | | | |
| Rate (ml/min) | 10.8 | 11.1 | 9.65 |
| Temperature (°C.) | 20 | 20 | 100 |
| Air-Gap (mm) | 25 | 15 | 7 |
| Coagulation Conditions: | | | |
| First Bath: | | | |
| Solvent Conc. (wt %) | 15 | 20 | 5 |
| Temperature (°C.) | 20 | 20 | 18 |
| Second Bath: | | | |
| Salt Content (wt %) | — | — | 40 |
| Temperature (°C.) | — | — | 95 |
| Wash/Draw Conditions: | | | |
| Wash Bath Content | — | — | Water |
| Wash Temp. (°C.) | — | — | 18/50 |
| Wet Draw Temp. (°C.) | 20 | 20 | 80 |
| Draw Bath Content | 20 wt % NMP | 20 wt % NMP | water |
| Wet Draw Ratio (X) | 2.4 | 2.1 | 2.5 |
| Wet Draw/ Total Draw (%) | 72 | 64 | 71 |
| Dry Draw Temp. (°C.) | 330 | 330 | 370 |
| Dry Draw Ratio (X) | 1.2 | 1.3 | 1.4 |
| Properties of Spun Fibers: | | | |
| Fineness (d.p.f.) | 2.2 | 3.5 | 3.3 |
| Tenacity (g/d) | 4.1 ± 0.6 | 4.0 ± 0.5 | 3.1 ± 0.3 |
| Elongation (%) | 37 ± 7 | 33 ± 7 | 29 ± 4 |

Note: The denier of a single filament (d.p.f.) is calculated from its fundamental resonant frequency, determined by vibrating a 30 mm length of fiber under tension with changing frequency. Single filaments are broken with a gauge length of 25.4 mm. All samples are elongated at a constant extension rate of 20 mm/min until the sample breaks. The results on 15 filaments are averaged. The denier is the fiber or yarn weight in grams per 9000 meters length.

While the invention has been described in detail and with reference to specific embodiments thereof, it will be apparent to one skilled in the art that various changes and modifications can be made therein without departing from the spirit and scope thereof.

What is claimed is:

1. A process for preparing fibers of soluble wholly aromatic polyamide comprising the following steps:

(a) extruding a polymerization mixture containing a wholly aromatic polyamide and polymerization solvent, where at least 85 mole percent of recurring structural units of said wholly aromatic polyamide is represented by one of the following formulas:

$$—[—NR_1—Ar_1NR_2—CO—Ar_2—CO—]—$$

or $$—[—NR_3—Ar_3—CO—]—$$

wherein $Ar_1$, $Ar_2$ and $Ar_3$ are aromatic radicals, and $Ar_1$ and $A_2$ are the same or different, $R_1$, $R_2$ and $R_3$ are a hydrogen atom or a lower alkyl group, and $R_1$ and $R_2$ are the same or different; through a spinneret having a plurality of capillary holes into a coagulation bath of a salt-free aqueous coagulation fluid containing from 3% to less than 40% by weight of an organic solvent to obtain coagulated and partially extracted filaments; and (b) drawing said coagulated and partially extracted filaments in a draw bath of a salt-free draw bath fluid containing from 3% to less than 40% by weight of an organic solvent to form fibers, said draw bath fluid being held at substantially ambient temperature below 50° C. but above freezing, with more than 60% of total drawing executed in the draw bath.

2. The process of claim 1, further comprising a step (c) of washing the drawn filaments with water at ambient temperature, drying and then winding up the drawn filaments as a multi-filament yarn.

3. The process of claim 2, further comprising a step (d) of subjecting said multi-filament yarn to hot drawing at a temperature near the glass transition temperature of said wholly aromatic polyamide.

4. The process of claim 1, wherein said wholly aromatic polyamide is poly(m-phenylene isophthalamide).

5. The process of claim 1, wherein said wholly aromatic polyamide is a copolymer containing more than 85 mole percent of m-phenylene isophthalamide repeat units.

6. The process of claim 4, wherein said polymerization solvent is N-methyl-2-pyrrolidone.

7. The process of claim 5, wherein said polymerization solvent is N-methyl-2-pyrrolidone.

8. The process of claim 1, wherein the resulting filaments have a linear density of greater than 0.25 denier/filament.

9. The process of claim 1, wherein said organic solvent of said aqueous coagulation fluid, said organic solvent of said draw bath fluid, and the polymerization solvent of said polymerization mixture are the same.

10. The process of claim 9, wherein each solvent is N-methyl-2-pyrrolidone.

11. The process of claim 4, wherein the poly(m-phenylene isophthalamide) has an intrinsic viscosity ($\rho_{inh}$) of 1.1 dL/g as measured at a polymer concentration (c) of 0.5 g/100 ml in 97% sulfuric acid at 30° C. and as determined from relative viscosity ($\rho_{rel}$) according to the following equation:

$$\rho_{inh}=ln(\rho_{rel})/c.$$

12. A process for preparing fibers of soluble wholly aromatic polyamide, comprising the following steps:

(a) extruding a polymerization mixture containing a wholly aromatic polyamide and polymerization solvent, where at least 85 mole percent of recurring structural units of said wholly aromatic polyamide is represented by one of the following formulas:

$$—[—NR_1—Ar_1—NR_2—CO—Ar_2—CO—]—$$

or $$—[—NR_3—Ar_3—CO—]—$$

wherein $Ar_1$, $Ar_2$ and $Ar_3$ are aromatic radicals, and $Ar_1$ and $Ar_2$ are the same or different, $R_1$, $R_2$ and $R_3$ are a hydrogen atom or a lower alkyl group, and $R_1$ and $R_2$ are the same or different; through a spinneret having a plurality of capillary holes into a coagulation bath of a salt-free aqueous coagulation fluid containing less than 40% by weight of an organic solvent to obtain coagulated and partially extracted filaments; and (b) drawing said coagulated and partially extracted filaments in a draw bath of a salt-free draw bath fluid containing less than 40% by weight of an organic solvent to form fibers, said draw bath fluid being held at substantially ambient temperature below 50° C. but above freezing, with more than 60% of total drawing executed in the draw bath, wherein said organic solvent of said aqueous coagulation fluid is the same as the polymerization solvent of said polymerization mixture.

13. A process for preparing fibers of soluble wholly aromatic polyamide, comprising the following steps:

(a) extruding a polymerization mixture containing a wholly aromatic polyamide and polymerization solvent, where at least 85 mole percent of recurring structural units of said wholly aromatic polyamide is represented by one of the following formulas:

$$—[—NR_1—Ar_1—NR_2—CO—Ar_2—CO—]—$$

or $$—[—NR_3—Ar_3—CO—]—$$

wherein $Ar_1$, $Ar_2$ and $Ar_3$ are aromatic radicals, and $Ar_1$ and $Ar_2$ are the same or different, $R_1$, $R_2$ and $R_3$ are a hydrogen atom or a lower alkyl group, and $R_1$ and $R_2$ are the same or different; through a spinneret having a plurality of capillary holes into a coagulation bath of a salt-free aqueous coagulation fluid containing less than 40% by weight of an organic solvent to obtain coagulated and partially extracted filaments; and (b) drawing said coagulated and partially extracted filaments in a draw bath of a salt-free draw bath fluid containing less than 40% by weight of an organic solvent to form fibers, said draw bath fluid being held at substantially ambient temperature below 50° C. but above freezing, with more than 60% of total drawing executed in the draw bath, wherein said organic solvent of said draw bath fluid is the same as the polymerization solvent of said polymerization mixture.

* * * * *